US009669631B2

(12) United States Patent
Takahashi

(10) Patent No.: US 9,669,631 B2
(45) Date of Patent: Jun. 6, 2017

(54) LIQUID SUPPLY MECHANISM AND PRINTING DEVICE

(71) Applicant: KYOCERA Document Solutions Inc., Osaka (JP)

(72) Inventor: So Takahashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/778,560

(22) PCT Filed: Jul. 24, 2014

(86) PCT No.: PCT/JP2014/069510
§ 371 (c)(1),
(2) Date: Sep. 18, 2015

(87) PCT Pub. No.: WO2015/016119
PCT Pub. Date: Feb. 5, 2015

(65) Prior Publication Data

US 2016/0297205 A1 Oct. 13, 2016

(30) Foreign Application Priority Data

Jul. 29, 2013 (JP) ..... 2013-156733

(51) Int. Cl.
*B41J 2/175* (2006.01)
*B41J 2/19* (2006.01)
(Continued)

(52) U.S. Cl.
CPC ..... *B41J 2/175* (2013.01); *B41J 2/17523* (2013.01); *B41J 2/18* (2013.01); *B41J 2/19* (2013.01); *B41J 2/21* (2013.01)

(58) Field of Classification Search
CPC .... B41J 2/175; B41J 2/17503; B41J 2/17513; B41J 2/17523; B41J 2/17533;
(Continued)

(56) References Cited

U.S. PATENT DOCUMENTS 6,010,210 A * 1/2000 Wilson ..... B41J 2/17503 347/7
6,520,630 B1 * 2/2003 Oda ..... B41J 2/17503 347/85
(Continued)

FOREIGN PATENT DOCUMENTS

JP 2008-162262 A 7/2008
JP 2010-125701 A 6/2010
(Continued)

OTHER PUBLICATIONS

International Search Report dated Oct. 14, 2014, issued to International Application No. PCT/JP2014/069510.

*Primary Examiner* — Anh T. N. Vo
(74) *Attorney, Agent, or Firm* — Stein IP, LLC

(57) ABSTRACT

An ink supply mechanism (50) provided with: a main tank (60); a sub-tank (70) for storing ink supplied from the main tank (60) and supplying the ink to an ink jet head (2); a first communication passage (52) one end of which communicates into the ink in the main tank (60) and the other end of which communicates into the ink in the sub-tank (70); and a second communication passage (53) one end of which communicates into the main tank (60) and the other end of which communicates with a position in the sub-tank (70) higher than the other end of the first communication passage (52), and part of which is disposed at a position higher than the liquid level of the ink in the main tank (60).

9 Claims, 10 Drawing Sheets

(51) Int. Cl.
*B41J 2/18* (2006.01)
*B41J 2/21* (2006.01)

(58) Field of Classification Search
CPC ..... B41J 2/17553; B41J 2/17556; B41J 2/17566; B41J 2/17518; B41J 2/17519
See application file for complete search history.

(56) References Cited

U.S. PATENT DOCUMENTS

| | | | | |
|---|---|---|---|---|
| 6,824,258 | B2 * | 11/2004 | Yamamoto | B41J 2/17513 347/86 |
| 7,252,377 | B2 * | 8/2007 | Nishioka | B41J 2/17513 347/7 |
| 7,290,849 | B2 * | 11/2007 | Yamazaki | B41J 2/17509 347/19 |
| 8,136,906 | B2 * | 3/2012 | Iwasaki | B41J 2/175 347/17 |
| 8,523,336 | B2 * | 9/2013 | Kuribayashi | B41J 2/175 347/85 |
| 2008/0158307 | A1 | 7/2008 | Nita et al. | 347/85 |
| 2010/0128098 | A1 | 5/2010 | Hashi et al. | 347/108 |
| 2011/0063381 | A1 | 3/2011 | Nitta et al. | 347/85 |

FOREIGN PATENT DOCUMENTS

| | | | |
|---|---|---|---|
| JP | 2010269606 | A | 12/2010 |
| JP | 2012-245672 | A | 12/2012 |

* cited by examiner

LIQUID SUPPLY MECHANISM AND PRINTING DEVICE

CROSS-REFERENCE TO RELATED APPLICATIONS

This application is a national stage of International Application No. PCT/JP2014/069510, filed Jul. 24, 2014, which claims the benefit of priority to Japanese Application No. 2013-156733, filed Jul. 29, 2013, in the Japanese Patent Office, the disclosures of which are incorporated herein by reference.

TECHNICAL FIELD

The present disclosure relates to a liquid supply mechanism that supplies a printing portion with a printing liquid such as ink or the like and to a printing device that includes the liquid supply mechanism.

BACKGROUND ART

Conventionally, a printing device is known which includes a liquid supply mechanism that supplies a printing liquid such as ink or the like to a printing portion. As this kind of printing device, for example, a patent literature 1 discloses a printing device including a liquid supply mechanism that has a main tank (ink cartridge) storing ink and a sub-tank (head tank). In this liquid supply mechanism, ink in the main tank is sent by a pump to the sub-tank to be stored, and the ink stored in the sub-tank is sent to the printing portion (recording head). And, in the liquid supply mechanism, when a liquid surface of the ink in the sub-tank falls, the pump is driven to perform ink supply from the main tank to the sub-tank. And, when the liquid surface of the ink in the sub-tank rises to a predetermined positon, the pump is stopped. In this way, the liquid surface of the ink in the sub-tank is kept at a constant level and the ink supply to the printing portion is stably performed.

CITATION LIST

Patent Literature

PLT1: JP-A-2012-245672

SUMMARY OF INVENTION

Technical Problem

In the meantime, as to the above liquid supply mechanism, there is a request for simplified control of the ink supply from the main tank to the sub-tank. In other words, in the above liquid supply mechanism, electric control is performed in which the liquid surface position in the sub-tank is sensed to control the driving of the pump. Accordingly, there is a problem that the control of the entire device becomes onerous.

The present disclosure has been made in light of such point, and it is an object of the present disclosure to provide: a liquid supply mechanism that is able to perform control of printing liquid supply from a main tank to a sub-tank without using electric control; and a printing device that includes the liquid supply mechanism.

Solution to Problem

To achieve the above object, in a liquid supply mechanism and printing device according to the present disclosure, when a liquid surface of a printing liquid in a sub-tank falls, the printing liquid is automatically supplied from a main tank to the sub-tank, thereafter, when the liquid surface in the sub-tank rises to a predetermined position, the printing liquid supply from the main tank to the sub-tank is automatically stopped.

Specifically, the liquid supply mechanism according to the present disclosure comprises: a main tank that is sealed and stores a printing liquid; a sub-tank which is disposed below the main tank, an inside of the sub-tank communicating with outside, the sub-tank storing the printing liquid supplied form the main tank and supplying the stored printing liquid to a printing portion; a first communication passage whose one end extends into the printing liquid in the main tank and whose other end extends into the printing liquid in the sub-tank; and a second communication passage one end of which extends into the main tank, other end of which extends to a position as high as or higher than the other end of the first communication passage in the sub-tank, and a portion of which is disposed at a position higher than a liquid surface of the printing liquid in the main tank.

According to the above structure, for example, as shown in FIG. 5, in the sub-tank, when the printing liquid is supplied to the printing portion and the liquid surface position of the printing liquid becomes lower than the other end of the second communication passage, the other end of the second communication passage contacts air. In other words, the other end of the second communication passage is opened to atmosphere. On the other hand, the other end of the first communication passage is always located in the printing liquid in the sub-tank. Because of this, air flows in from the other end of the second communication passage and flows into the main tank, and the printing liquid in the main tank flows, under gravity, to the sub-tank through the first communication passage. In other words, because the main tank is sealed, the printing liquid in the main tank flows out to the first communication passage by a volume of the air flowing in from the second communication passage. Here, a part of the second communication passage is disposed at the position higher than the liquid surface of the printing liquid in the main tank. Accordingly, it is possible to make the printing liquid in the main tank flow out to the first communication passage rather than to the second communication passage. Besides, in the sub-tank, because the inside communicates with outside air, the inside does not have a negative pressure, and the air surely flows into the second communication passage.

In the sub-tank, for example, as shown in FIG. 6, when the liquid surface rises because of the printing liquid flowing in from the first communication passage and the liquid surface reaches the other end of the second communication passage, the other end of the second communication passage is closed by the printing liquid. In this way, as to a U-shaped flow passage composed of the first communication passage, the main tank and the second communication passage connected to one another successively, a state is obtained, in which both ends are closed by the printing liquid and air exists in a portion between both ends. In the flow passage in this state, the printing liquid flows in such a manner that a hydraulic head (head) difference between the printing liquid in the main tank and first communication passage and the printing liquid in the second communication passage becomes zero. Specifically, when the liquid surface in the sub-tank reaches the other end of the second communication passage, the printing liquid in the sub-tank flows into the second communication passage and the printing liquid in the main tank continues to flow into the sub-tank through the first communication passage. And, when the liquid surface of the printing liquid in the second communication passage and the liquid surface of the printing liquid in the main tank become equal to each other in height, the above hydraulic head (head) difference becomes zero and the flow of the printing liquid stops. At this time, the liquid surface in the sub-tank is kept at the same height as the other end of the second communication passage. And, when the printing liquid is supplied again from the sub-tank to the printing portion and the liquid surface in the sub-tank becomes lower than the other end of the second communication passage, the above operation is repeated and the liquid surface in the sub-tank rises to the other end of the second communication passage.

As described above, according to the liquid supply mechanism of the present disclosure, when the liquid surface in the sub-tank falls, it becomes possible to automatically supply the printing liquid from the main tank and thereby keep the liquid surface in the sub-tank at a predetermined position (the other end position of the second communication passage).

Besides, in the liquid supply mechanism according to the present disclosure, it is preferable that the main tank is provided with a partition member that partitions an inside of the main tank into a storing portion for the printing liquid and an air portion, and moves in accordance with reduction in the printing liquid of the storing portion.

According to the above structure, because the main tank is provided with the partition member, it is possible to alleviate the printing liquid and the air contacting each other. In this way, it is possible to prevent the air from entering the printing liquid to deteriorate the printing liquid. Besides, because the partition member moves in accordance with reduction in the printing liquid, it is possible to surely make the printing liquid flow out to the first communication passage by the volume of the air flowing in. In other words, according to the structure of the present disclosure, it is possible to increase and decrease the stored volume of the printing liquid and the air volume while preventing the printing liquid and the air from contacting each other in the main tank.

Besides, in the liquid supply mechanism according to the present disclosure, it is preferable the partition member is a liquid bag that is housed in the main tank, has flexibility, and is filled with the printing liquid.

According to the above structure, because the flexible liquid bag is used as the partition member, it is possible to easily increase and decrease the stored volume of the printing liquid and the air volume while preventing the printing liquid and the air from contacting each other. Besides, because of the liquid bag, replacement of the printing liquid in the main tank becomes easy.

Besides, in the liquid supply mechanism according to the present disclosure, it is preferable that in the main tank, a cylindrical member and a lid member, which is provided with respective connection apertures for the first communication passage and the second communication passage, are screwed to each other, whereby a sealed space for storing the printing liquid is formed.

According to the above structure, the cylindrical member and the lid member are screwed to each other, whereby the main tank forms the sealed space. Accordingly, it becomes possible to easily form the sealed space and the replacement of the printing liquid becomes easy. Besides, because the lid member is provided with the connection apertures for the first communication passage and the second communication passage, adjustment of a connection position between the main tank and the first communication passage and a connection position between the main tank and the second communication passage becomes easy.

Besides, a printing device according to the present disclosure comprises the above liquid supply mechanism, and a printing portion that is supplied with the printing liquid from the sub-tank of the liquid supply mechanism to apply printing to a print medium. Accordingly, when the liquid surface in the sub-tank falls, it is possible to automatically supply the printing liquid from the main tank to the sub-tank and thereby keep the liquid surface in the sub-tank at the predetermined position (the other end position of the second communication passage).

Besides, it is preferable that the printing device according to the present disclosure comprises a supply passage whose one end extends into the printing liquid in the sub-tank and whose other end communicates with the printing portion; wherein the printing portion is disposed at a position higher than a liquid surface of the printing liquid in the sub-tank; and the printing liquid in the sub-tank is supplied through the supply passage by capillarity of the printing portion.

In a case where the printing portion is disposed at a position lower than the liquid surface in the sub-tank to supply the printing liquid from the sub-tank to the printing portion by means of the hydraulic head (head) difference of the printing liquid in the sub-tank, there is a risk that an excessive amount of the printing liquid would be supplied to the printing portion and the printing liquid would overflow. In contrast to this, according to the above structure, the printing portion is disposed at the position higher than the liquid surface in the sub-tank to supply the printing liquid from the sub-tank to the printing portion by means of the capillarity in the printing portion. In other words, according to the above structure, the printing liquid in the sub-tank, which is located below the printing portion, is pulled up to the printing portion by the capillarity. Because of this, the printing liquid is consumed by the printing portion and thereby the capillarity occurs, whereby it is possible to supply a necessary amount of the printing liquid to the printing portion, and as a result of this, it is possible to prevent the printing liquid from overflowing from the printing portion.

Besides, according to the above structure, the hydraulic head (head) of the printing liquid in the sub-tank, that is, the liquid surface position of the printing liquid is important. The printing liquid in the sub-tank is supplied to the printing portion by its own hydraulic head pressure and pull-up force of the above capillarity. Because of this, if the liquid surface position in the sub-tank becomes lower than the predetermined position (designed position), it becomes impossible to secure the desired hydraulic head pressure and becomes difficult to supply a necessary amount of the printing liquid from the sub-tank to the printing portion. In this point, in the printing device according to the present disclosure, because it is possible to keep the liquid surface position in the sub-tank at the predetermined position, it becomes possible to surely supply the necessary amount of the printing liquid from the sub-tank to the printing portion.

Besides, it is preferable that the printing device according to the present disclosure comprises a plurality of the printing portions that perform printing by using printing liquids that have colors different from one another; and a plurality of the liquid supply mechanisms that supply a printing liquid corresponding to each of the printing portions; wherein the plurality of the printing portions are fixedly disposed successively in a conveyance direction of the print medium.

The printing device having the above structure is of so-called line type in which the print medium passes under the plurality of printing portions fixedly disposed successively to be printed. In recent years, in the printing device of this line type, a fast printing speed is desired. Because of this, supply frequency of the printing liquid from the main tank to the sub-tank becomes high. Accordingly, in the conventional printing device that performs the printing liquid supply from the main tank to the sub-tank by using electric devices such as a pump and the like, use frequency of the electric devices becomes high, and as a result of this, the life of the electric devices becomes short. In this point, in the printing device according to the present disclosure, because the printing liquid supply from the main tank to the sub-tank is automatically performed without using the electric devices, it is possible to obviate the above problems.

Advantageous Effects of Invention

As described above, according to the present disclosure, when the liquid surface in the sub-tank falls, the printing liquid is automatically supplied from the main tank to the sub-tank and the liquid surface in the sub-tank is kept at the predetermined position. Accordingly, it is possible to surely perform the control of the printing liquid supply from the main tank to the sub-tank without using the electric control.

DESCRIPTION OF EMBODIMENTS

Hereinafter, embodiments of the present disclosure are described in detail based on the drawings. In the meantime, the present disclosure is not limited to the embodiments described below.

<Printing Device>

Figure 1:
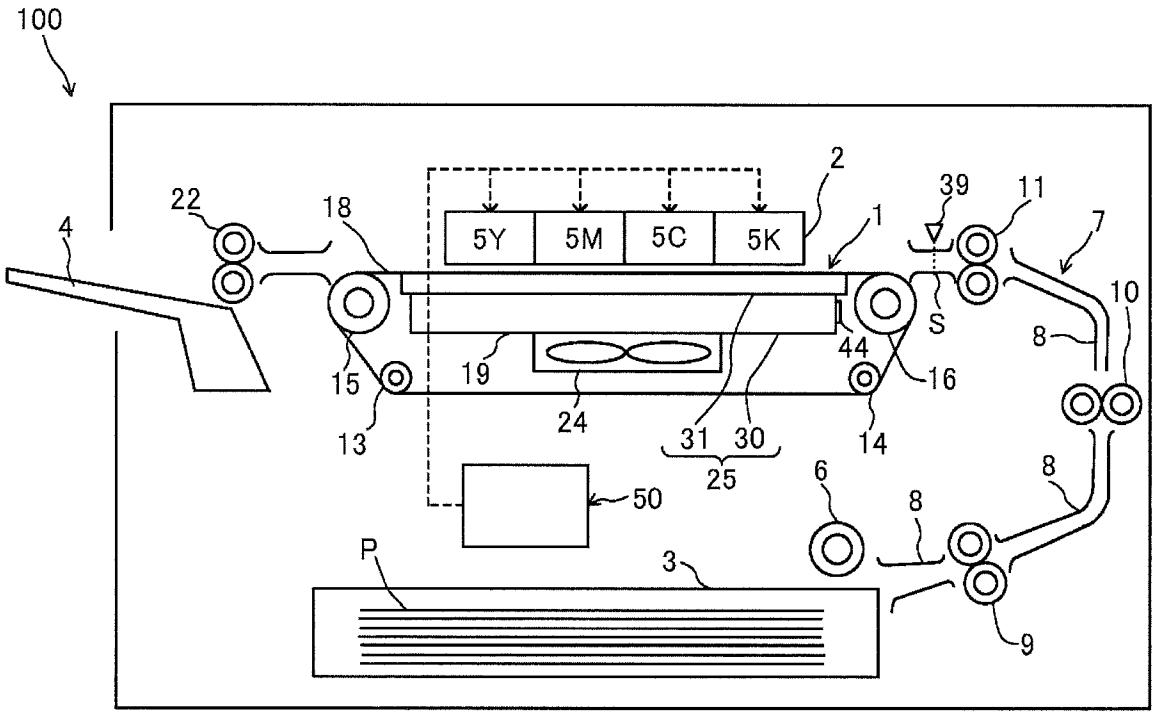
FIG. 1 is a view showing a structure of a printing device according to an embodiment.

As shown in FIG. 1, a printing device 100 according to the present embodiment composes an ink jet printer, and includes: an ink jet head 2 that ejects ink onto a paper sheet P as a print medium to perform printing; a sheet feeding cassette 3 that houses the sheet P; a sheet conveyance device 1 that is disposed to oppose the ink jet head 2; a discharge tray 4 that houses the sheet P after being printed; and an ink supply mechanism 50 that supplies ink to the ink jet head 2. The ink jet head 2 composes a printing portion according to the present disclosure, the ink supply mechanism 50 is a liquid supply mechanism according to the present disclosure, and the ink is a printing liquid of the present disclosure. In the meantime, in the description performed below, an "upstream side" and a "downstream side" mean an upstream side and a downstream side in a sheet conveyance direction, respectively.

The ink jet head 2 has four printing portions (line heads 5Y, 5M, 5C, 5K) that are fixedly disposed successively along a sheet conveyance direction (left-right direction of FIG. 1) in the sheet conveyance device 1. The line heads 5Y, 5M, 5C, 5K eject different color inks of yellow (Y), magenta (M), cyan (C), and black (K), respectively. A lower surface of the ink jet head 2 is provided with many nozzles for each line head 5Y, 5M, 5C, and 5K. In each line head 5Y, 5M, 5C, and 5K, the ink supplied from the ink supply mechanism 50 is filled into a pressure chamber, and by changing a volume of the pressure chamber by using a piezo-electric element, the ink is ejected from the nozzle. Details of the ink supply mechanism 50 are described later.

The sheet feeding cassette 3 is disposed in a lower portion of the printing device 100 and able to stack and house a plurality of paper sheets P. The sheet feeding cassette 3 is provided therein with a width limit plate of slide type (not shown) that limits a width-directional position of the sheet P.

The sheet feeding cassette 3 is provided with a sheet feeding roller 6 for performing sheet feeding. A downstream side of the sheet feeding roller 6 is provided with a conveyance route 7 for guiding the sheet P in the sheet feeding cassette 3 to the sheet conveyance device 1. The conveyance route 7 is composed of guide plates 8. The conveyance route 7 is provided with a first conveyance roller pair 9, a second conveyance roller pair 10, and a registration roller pair 11 successively from an upstream side to a downstream side. And, the sheet P fed from the sheet feeding cassette 3 by the sheet feeding roller 6 is conveyed to the registration roller pair 11 by the first and second conveyance roller pairs 9, 10 and sent to the sheet conveyance device 1 by the registration roller pair 11 at a predetermined timing.

The sheet conveyance device 1 is disposed under the ink jet head 2 to oppose the ink jet head 2. And, the sheet conveyance device 1 conveys the sheet P supplied by the registration roller pair 11 from a nearby position in an upstream side of the ink jet head 2 to a nearby position in a downstream side of the ink jet head 2. A downstream side of the sheet conveyance device 1 is provided with a sheet discharge roller pair 22 and a sheet discharge tray 4.

The sheet conveyance device 1 has: a drive roller 15; a driven roller 16; two tension rollers 13, 14; an annular conveyance belt 18 wound around these four rollers 13-16; and a negative pressure generation device 19 that is disposed on an inner side in a radial direction of the conveyance belt 18.

The drive roller 15 is a roller for transmitting drive force to the conveyance belt 18, and disposed in a more downstream side than the ink jet head 2. The drive roller 15 is connected to a drive motor (not shown) in a drive force transmittable manner.

The driven roller 16 is disposed in a more upstream side than the ink jet head 2. The driven roller 16 is disposed at the substantially same height positon as the drive roller 15. The tension rollers 13, 14 are rollers for adjusting tension of the conveyance belt 18, and disposed below the drive roller 15 and the driven roller 16.

An upper surface of the conveyance belt 18 forms a sheet conveyance surface for conveying the sheet P. The upper surface of the conveyance belt 18 extends substantially in parallel with the lower surface of the ink jet head 2. And, the conveyance belt 18 attracts and holds to convey the sheet P on the upper surface. Although not shown, the conveyance belt 18 is provided with many venting holes that penetrate the conveyance belt 18 in a belt thickness direction. Each venting hole has a function of exerting a negative pressure generated by the negative pressure generation device 19 onto the sheet P.

The negative pressure generation device 19 has a fan case 25 on which a fan 24 is mounted. The fan case 25 is composed of a case main body 30 opened upward and a thick ceiling plate portion 31 that covers the upper side of the case main body 30. The fan 24 is mounted on a lower surface of the case main body 30. The fan 24 is driven to generate a negative pressure in the fan case 25.

The ceiling plate portion 31 is in contact with an inner circumferential surface of the conveyance belt 18, and guides and supports the sheet P held on the upper surface of the conveyance belt 18 via the conveyance belt 18 from below. In this way, the ceiling plate portion 31 functions as a support portion.

<Structure of the Ink Supply Mechanism>

Figure 2:
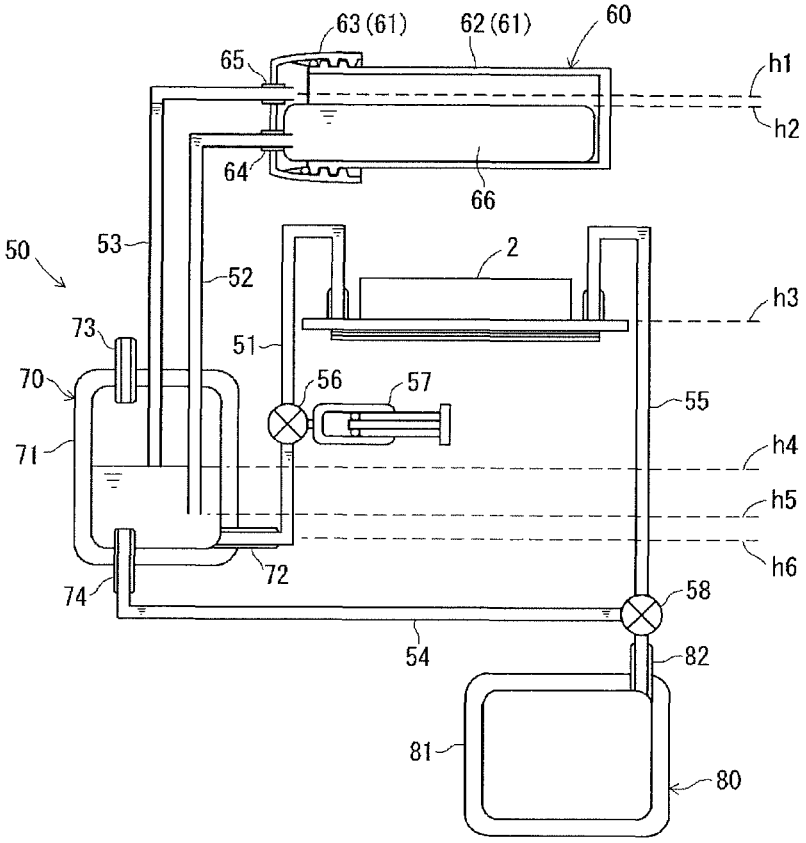
FIG. 2 is a flow passage system view showing a structure of an ink supply mechanism according to an embodiment.

A structure of the ink supply mechanism 50 according to the present embodiment is described with reference to FIG. 2 and FIG. 3. The ink supply mechanisms 50 are disposed to the number of 4 correspondingly to the four respective printing portions (line heads 5Y, 5M, 5C, 5K). As shown in FIG. 2, each ink supply mechanism 50 includes a main tank 60, a sub-tank 70, a wasted liquid tank 80, a supply passage 51, a first communication passage 52, a second communication passage 53, a connection passage 54, and an outlet passage 55.

The main tank 60 is a sealed tank that stores ink. The sub-tank 70 is disposed below the main tank 60, stores ink from the main tank 60, and supplies the stored ink to the predetermined line heads 5Y, 5M, 5C, and 5K (hereinafter, simply called a line head). The first communication passage 52 and the second communication passage 53 are connected between the main tank 60 and the sub-tank 70.

Figure 3:
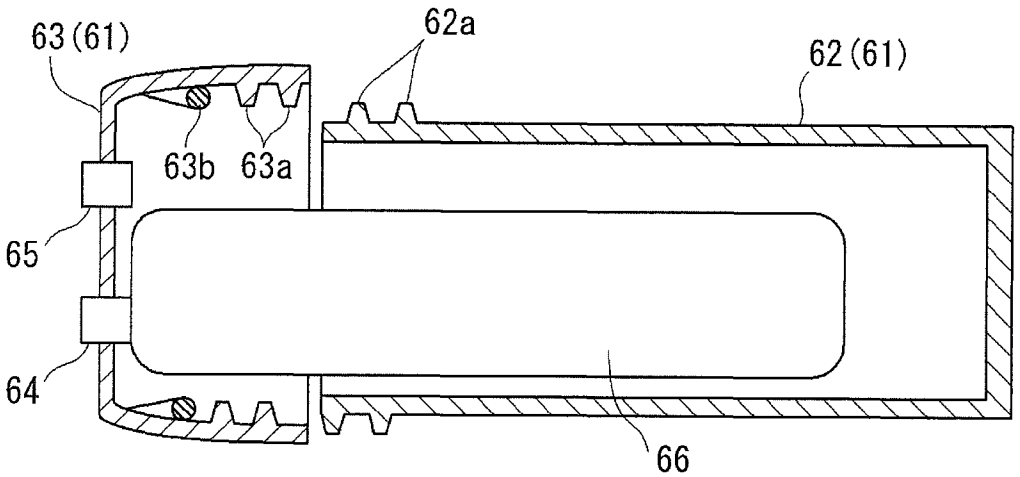
FIG. 3 is a cross-sectional view showing a structure of a main tank.

As shown in FIG. 3, the main tank 60 has a sealed tank main body 61, and an ink bag 66 is housed in the tank main body 61. In the tank main body 61, a cylindrical member 62 whose one end is closed and a lid member 63 are screwed to each other to form a sealed space. Specifically, an open end side of the cylindrical member 62 is provided with a tap 62*a*, and an inner surface of the lid member 63 is provided with a tap 63*a* that is screwed to the tap 62*a* of the cylindrical member 62. Besides, an inner surface of the lid member 63 is provided with a seal member 63*b* that seals an outer circumferential surface of the cylindrical member 62 and an inner surface of the lid member 63 from each other. The lid member 63 is provided with a first connection aperture 64 connected to the first communication passage 52 and a second connection aperture 65 connected to the second communication passage 53.

The ink bag 66 is a flexible liquid bag which is filled with ink. The ink bag 66 composes a partition member that partitions the inside, that is, the sealed space of the tank main body 61 into an ink storing portion and an air portion, and moves in accordance with reduction in the ink.

The sub-tank 70 has a tank main body 71, and the tank main body 71 is provided with a supply aperture 72, a venting aperture 73, and a connection aperture 74. As to the sub-tank 70, an inside of the tank main body 71 contacts outside air via the venting aperture 73. The supply aperture 72 and the connection aperture 74 are disposed through a bottom portion of the tank main body 71, and the venting aperture 73 is disposed through an upper portion of the tank main body 71.

One end of the first communication passage 52 is connected to the first connection aperture 64 of the main tank 60 to extend into the ink in the ink bag 66. The other end of the first communication passage 52 penetrates the tank main body 71 of the sub-tank 70 to extend into the ink stored in the tank main body 71. Besides, in the sub-tank 70, a position (h5) of the other end of the first communication passage 52 is higher than a position (h6) of the supply aperture 72.

One end of the second communication passage 53 is connected to the second connection aperture 65 of the main tank 60 to extend into the air portion in the tank main body 61. The other end of the second communication passage 53 penetrates the tank main body 71 of the sub-tank 70 to extend into the tank main body 71. In the main tank 60, a position (h1) of the one end of the second communication passage 53 is higher than the uppermost position (h2) of the ink bag 66. In other words, a portion of the second communication passage 53 is disposed at a position higher than a liquid surface (h2) of the ink in the main tank 60. Besides, in the sub-tank 70, a position (h4) of the other end of the second communication passage 53 is as high as or higher than a position (h5) of the other end of the first communication passage 52. In other words, in the sub-tank 70, the position (h4) of the other end of the second communication passage 53 is higher than the position (h6) of the supply aperture 72.

As to the supply passage 51, one end is connected to the supply aperture 72 of the sub-tank 70 to extend into the ink, and the other end communicates with a predetermined line head of the ink jet head 2. A position (h3) of the ink jet head 2 (line head) is higher than the liquid surface (h4) of the ink in the sub-tank 70. The ink in the sub-tank 70 is pulled up and supplied to the ink jet head 2 (line head) through the supply passage 51 by capillarity generated by the ink being ejected from the nozzle.

The supply passage 51 is provided with a switching valve 56 and a pump 57. The pump 57 forcibly introduces the ink into the supply passage 51 to send the ink to the ink jet head 2 (line head). The switching valve 56 switches the passage to a state (stopping time of the pump 57) in which the ink jet head 2 and the supply aperture 72 of the sub-tank 70 communicate with each other and a state (driving time of the pump 57) in which the ink jet head 2 and the pump 57 communicate with each other.

As to the outlet passage 55, one end is connected to the ink jet head 2 (line head) and the other end is connected to the wasted liquid tank 80. The wasted liquid tank 80 has a tank main body 81, and the outlet passage 55 is connected to an inlet aperture 82 disposed through the tank main body 81. As to the connection passage 54, one end is connected to the connection aperture 74 of the sub-tank 70, and the other end is connected to a point of the outlet passage 55.

The connection portion between the outlet passage 55 and the connection passage 54 is provided with a switch valve 58. This switch valve 58 switches the passages to a state in which the ink jet head 2 (line head) and the connection passage 54 communicate with each other and a state in which the ink jet head 2 and the wasted liquid tank 80 communicate with each other. For example, at an introduction time of the printing device 100, when initially introducing the ink into the ink jet head 2 or when removing air bubbles and the like occurring in the ink jet head 2, the ink is forcibly supplied by the pump 57 to the ink jet head 2, and in accordance with the supply, the ink pushed out from the ink jet head 2 flows into the outlet passage 55. And, it is selected by the switchover of the switch valve 58 to which one of the sub-tank 70 and the wasted liquid tank 80 to send the ink.

<Operation of the Ink Supply Mechanism>

Operation of the ink supply mechanism 50 according to the present embodiment is described with reference to FIG. 4-FIG. 6. In the ink supply mechanism 50, when the liquid surface of the ink in the sub-tank 70 becomes lower than the predetermined position (h4), the ink is automatically supplied from the main tank 60 to the sub-tank 70, thereafter, when the liquid surface in the sub-tank 70 rises to the above predetermined position, the ink supply from the main tank 60 to the sub-tank 70 is automatically stopped. Specifically, the operation is performed as described below.

Figure 4:
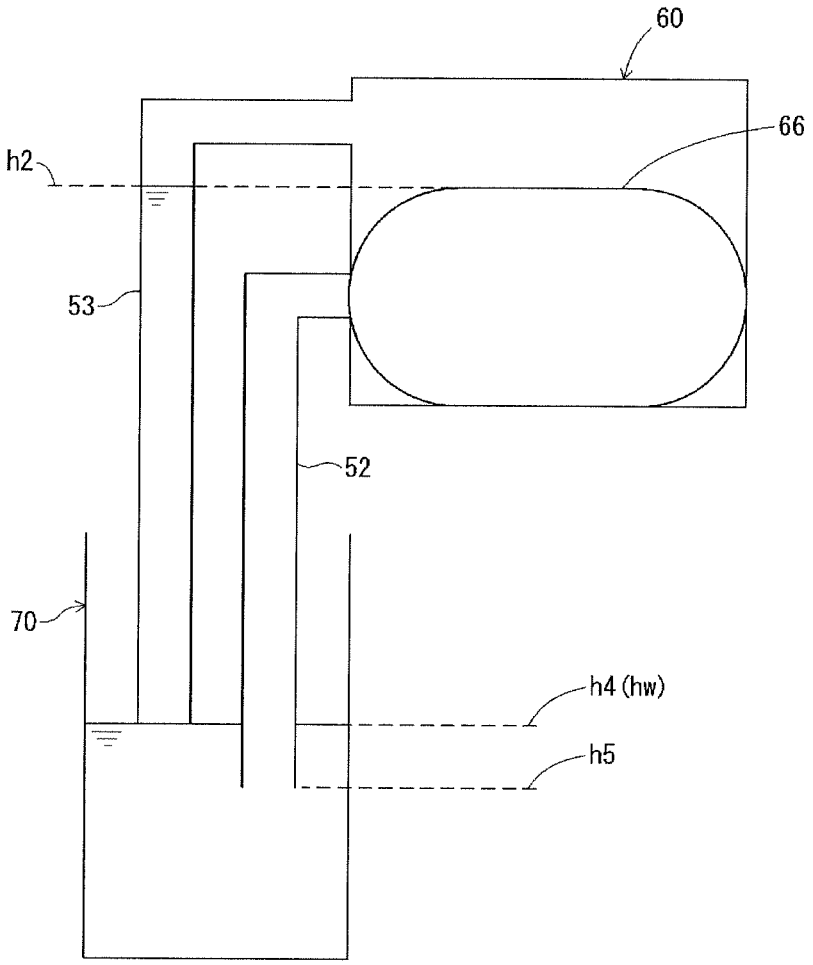
FIG. 4 is a cross-sectional view showing an ink supply operation of an ink supply mechanism.

First, as shown in FIG. 4, a state is studied, in which the liquid surface position (hw) in the sub-tank 70 is as high as or higher than the other end position (h4) of the second communication passage 53. In the meantime, the other end position (h5) of the first communication passage 52 is lower than the liquid surface position (hw) in the sub-tank 70. In this state, as to a substantially U-shaped flow passage composed of the first communication passage 52, the main tank 60, and the second communication passage 53 which are successively connected to one another, both ends are closed by the ink and air exists in a portion between both ends. In the passage in this state, the liquid surface position of the ink in the main tank 60 and the liquid surface position of the ink in the second communication passage 53 become equal to each other in height in such a manner that a hydraulic head (head) difference between the ink in the main tank 60 and first communication passage 52 and the ink in the second communication passage 53 becomes zero (see h2 in FIG. 4). And, in this state, there is no ink flow between the main tank 60 and the sub-tank 70.

Figure 5:
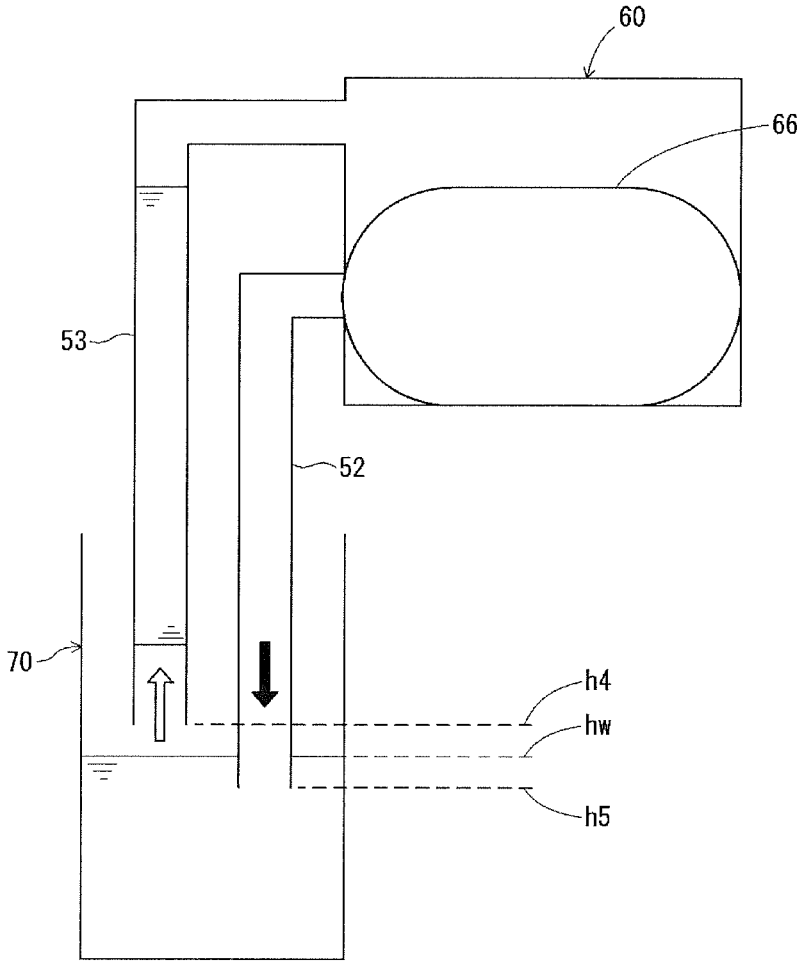
FIG. 5 is a view corresponding to FIG. 4 showing an ink supply operation of an ink supply mechanism.

Next, as shown in FIG. 5, in the sub-tank 70, when the ink is supplied to the ink jet head 2 (line head) through the supply passage 51 and the liquid surface position (hw) of the ink becomes lower than the other end position (h4) of the second communication passage 53, the other end of the second communication passage 53 contacts air. In other words, the other end of the second communication passage 53 is opened to atmosphere. On the other hand, the other end of the first communication passage 52 is always located in the ink in the sub-tank 70. Because of this, air flows in from the other end of the second communication passage 53 and flows to the main tank 60 (outline arrow shown in FIG. 5), and the ink in the main tank 60 flows under gravity to the sub-tank 70 through the first communication passage 52 (black arrow shown in FIG. 5). Because the main tank 60 is sealed, the ink flows out to the first communication passage 52 by a volume of the air flowing in from the second communication passage 53.

Here, because a portion of the second communication passage 53 is disposed at the position higher than the liquid surface of the ink in the main tank 60, it is possible to surely make the ink in the main tank 60 flow out to the first communication passage 52 rather than to the second communication passage 53. Besides, as to the sub-tank 70, because outside air flows inside the sub-tank 70 through the venting aperture 73, the inside does not have a negative pressure and the air surely flows into the second communication passage 53.

Figure 6:
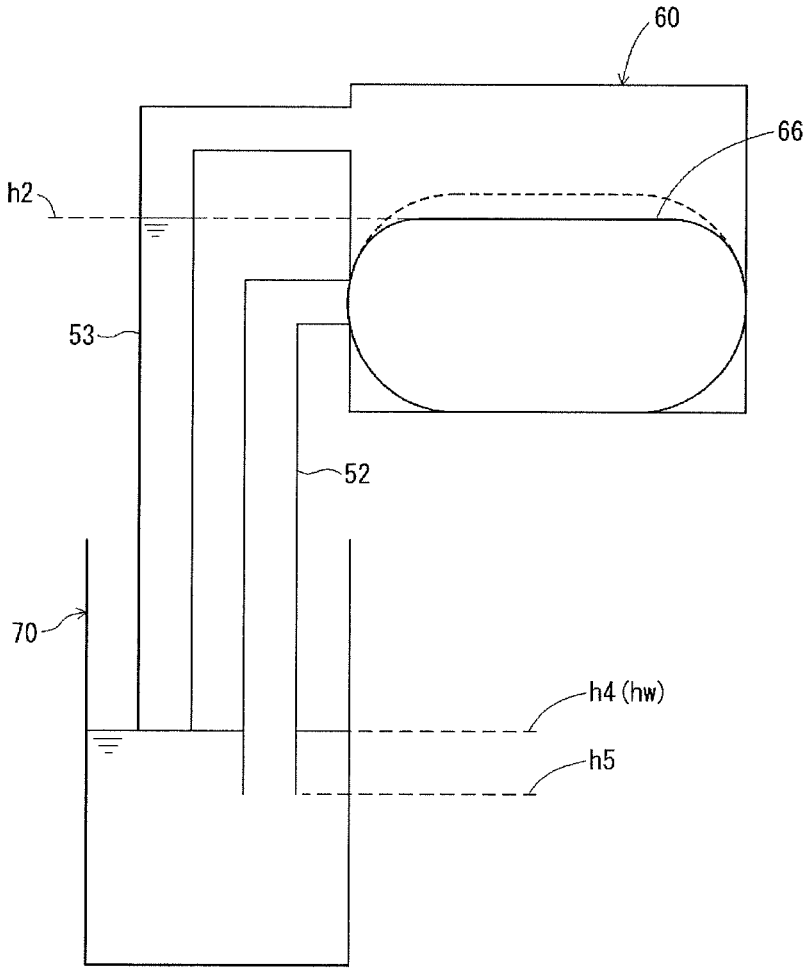
FIG. 6 is a view corresponding to FIG. 4 showing an ink supply operation of an ink supply mechanism.

As shown in FIG. 6, when the ink flows into the sub-tank 70 from the first communication passage 52 and the liquid surface rises to reach the other end of the second communication passage 53, the other end of the second communication passage 53 is closed by the ink. In this way, as to the substantially U-shaped flow passage composed of the first communication passage 52, the main tank 60, and the second communication passage 53 which are successively connected to one another, both ends are closed by the ink and air exists in a portion between both ends.

In the passage in this state, as described above, the ink flows in such a manner that the hydraulic head (head) difference between the ink in the main tank 60 and first communication passage 52 and the ink in the second communication passage 53 becomes zero. Specifically, when the liquid surface in the sub-tank 70 reaches the other end of the second communication passage 53, the ink in the sub-tank 70 flows into the second communication passage 53 and the ink in the main tank 60 continues to flow into the sub-tank 70 through the first communication passage 52. And, when the liquid surface of the ink in the second communication passage 53 and the liquid surface of the ink in the main tank 60 become equal to each other in height (see h2 in FIG. 6), the hydraulic head (head) difference between both inks becomes zero and the ink flow stops. At this time, the liquid surface position (hw) in the sub-tank 70 is kept at the same height as the other end position (h4) of the second communication passage 53.

And, when the ink is supplied again from the sub-tank 70 to the ink jet head 2 (line head) and the liquid surface in the sub-tank 70 becomes lower than the other end of the second communication passage 53, the above operation is repeated and the liquid surface in the sub-tank 70 rises to the other end of the second communication passage 53.

As described above, according to the ink supply mechanism 50 of the present embodiment, when the liquid surface in the sub-tank 70 falls, it is possible to automatically supply the ink in the main tank 60 to the sub-tank 70 thereby keep the liquid surface in the sub-tank 70 at the predetermined position (the other end position h4 of the second communication passage). Accordingly, it is possible to surely perform the control of the ink supply from the main tank 60 to the sub-tank 70 without using electric components such as a pump, a sensor and the like, that is, without performing the electric control. Therefore, it is possible to alleviate the control of the entire printing device 100 becoming onerous.

Besides, because the main tank 60 uses the ink bag 66 to store the ink, it is possible to prevent the ink and the air from contacting each other in the main tank 60. In this way, it is possible to prevent the air from entering the ink and deteriorating the ink.

Besides, because the ink bag 66 has flexibility, the ink bag 66 moves in accordance with the reduction in the ink. Because of this, it is possible to surely make the ink flow out to the first communication passage 52 by the volume of the air flowing in from the second communication passage 53. In other words, according to the ink supply mechanism 50 of the present embodiment, it is possible to easily increase and decrease the stored volume of the ink and the air volume while preventing the ink and the air from contacting each other in the main tank 60. Besides, because the ink bag 66 is a bag, the replacement of the ink in the main tank 60 becomes easy.

Besides, the cylindrical member 62 and the lid member 63 are screwed to each other, whereby the main tank 60 forms the sealed space in which the ink is stored. Accordingly, it becomes possible to easily form the sealed space and the replacement of the ink becomes easy. Besides, because the lid member 63 is provided with the connection apertures 64, 65 respectively for the first communication passage 52 and the second communication passage 53, adjustment of the connection position between the main tank 60 and the first communication passage 52 and the connection positon between the main tank 60 and the second communication passage 53 becomes easy.

Besides, unlike the printing device 100 according to the present embodiment, in a case where the ink jet head is disposed at a position lower than the liquid surface in the sub-tank to supply the ink from the sub-tank to the ink jet head by means of the hydraulic head (head) difference of the ink in the sub-tank, there is a risk that an excessive amount of the ink would be supplied to the ink jet head and the ink would overflow.

In contrast to this, according to the printing device 100 of the present embodiment, the ink jet head 2 (line head) is disposed at the position higher than the liquid surface in the sub-tank 70 to supply the ink from the sub-tank 70 to the ink jet head 2 (line head) by means of the capillarity occurring in the ink jet head 2. In other words, according to the present embodiment, the ink in the sub-tank 70, which is located below the ink jet head 2, is pulled up to the ink jet head 2 by the capillarity. Because of this, the ink is ejected (consumed) by the ink jet head 2 (line head) and thereby the capillarity occurs, whereby it is possible to supply the necessary amount of the ink to the ink jet head 2, and as a result of this, it is possible to prevent the ink from overflowing from the ink jet head 2.

Besides, according to the printing device 100 of the present embodiment, the hydraulic head (head) of the ink in the sub-tank 70, that is, the liquid surface position of the ink is important. The ink in the sub-tank 70 is supplied to the ink jet head 2 by its own hydraulic head pressure and the pull-up force of the above capillarity. Because of this, if the liquid surface position in the sub-tank 70 becomes lower than the predetermined position (the other end position h4 of the second communication passage 53), it becomes impossible to secure the desired hydraulic head pressure and becomes difficult to supply the necessary amount of the ink from the sub-tank 70 to the ink jet head 2. In this point, in the printing device 100 according to the present embodiment, because it is possible to keep the liquid surface position in the sub-tank 70 at the predetermined position, it is possible to surely supply the necessary amount of the ink from the sub-tank 70 to the ink jet head 2.

Besides, as in the present embodiment, in the printing device of line type in which the plurality of line heads (printing portions) are fixedly disposed successively along the conveyance direction of the sheet, because of the high printing speed, a reduction rate of the ink in the sub-tank becomes fast, and in accordance with which, supply frequency of the ink from the main tank to the sub-tank becomes high. Accordingly, in the conventional printing device that uses electric devices such as a pump and the like to perform the ink supply from the main tank to the sub-tank, use frequency of the electric devices becomes high, and as a result of which, the life of the electric devices becomes short. In this point, in the printing device 100 according to the present embodiment, because the ink supply from the main tank 60 to the sub-tank 70 is automatically performed without using the electric devices, it is possible to obviate the above problems. In other words, it is especially useful to use the ink supply mechanism 50 of the present embodiment for the printing device of line type.

—Modifications of The Embodiment—

<Modification 1>

In the main tank 60 of the above embodiment, the ink bag 66 partitions the ink storing portion and the air portion from each other. However, in the present modification, a gasket 67 is used to partition the ink storing portion and the air portion from each other.

Figure 7:
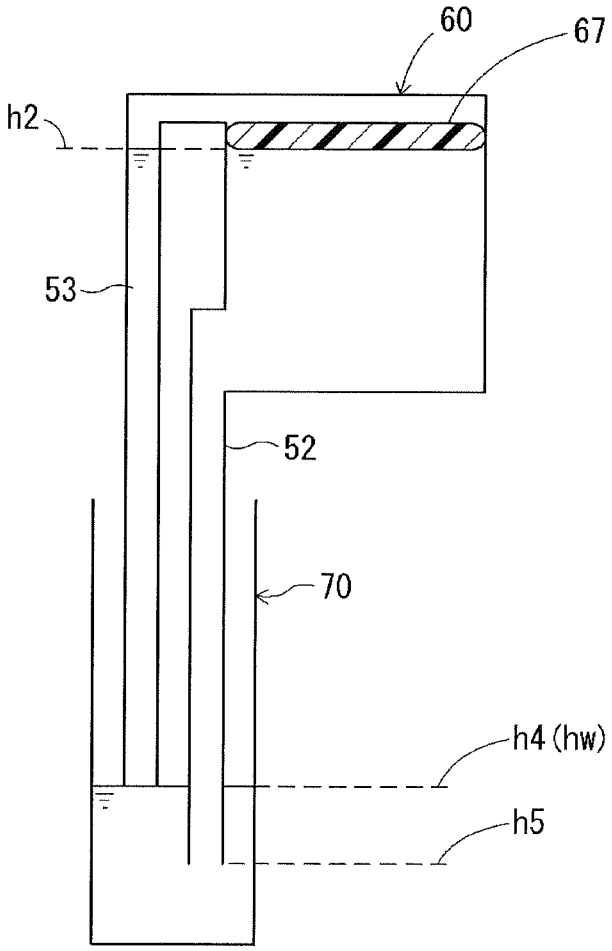
FIG. 7 is a cross-sectional view showing a schematic structure of an ink supply mechanism according to a modification 1 of an embodiment.

Specifically, in the main tank 60 of the present modification, as shown in FIG. 7, the gasket 67 is disposed on the liquid surface of the ink stored in the main tank 60. The gasket 67 is disposed to cover an entirety of the liquid surface of the ink. Besides, the gasket 67 is composed to move downward an inner surface of the main tank 60 in accordance with the reduction in the ink In this way, like the above embodiment, in the main tank 60, it is possible to easily increase and decrease the stored volume of the ink and the air volume while preventing the ink and the air from contacting each other in the main tank 60.

<Modification 2>

Figure 8A:
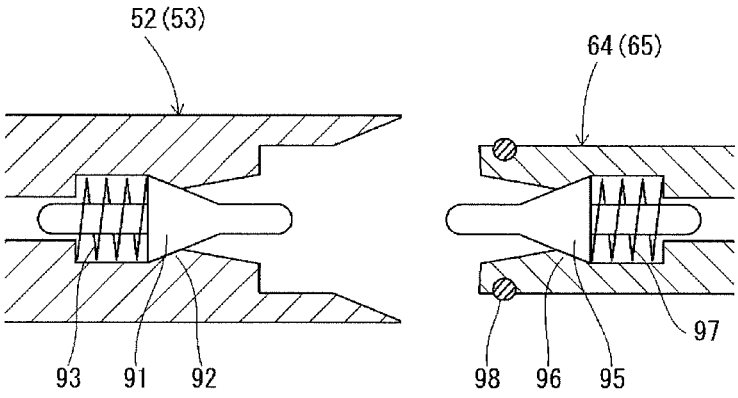
FIG. 8A shows a cross-sectional view of a state before connecting a communication passage and a connection aperture to each other in a modification 2 of an embodiment.
Figure 8B:
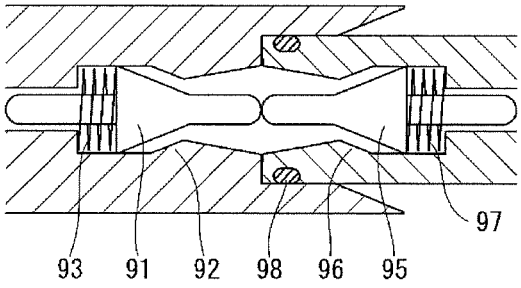
FIG. 8B shows a cross-sectional view of a state in which the communication passage and the connection aperture are connected to each other in the modification 2 of the embodiment.

In the ink supply mechanism 50 according to the above embodiments, a mountable/demountable joint shown in FIG. 8A, 8B may be used for the connection between each communication passage 52, 53 and each connection aperture 64, 65 of the main tank 60.

An end portion of each communication passage 52, 53 is provided with a joint that has: a valve body 91 movable in a passage direction; a valve seat 92 on which the valve body 91 seats to close the passage; and a spring 93 that biases the valve body 91 in the seating direction. Like the communication passages 52, 53, each connection aperture 64, 65 is provided with a joint that has: a valve body 95 movable in the passage direction; a valve seat 96 on which the valve body 95 seats to close the passage; and a spring 97 that biases the valve body 95 in the seating direction.

The communication passages 52, 53 and the connection apertures 64, 65 are fitted and connected to each other respectively. In the communication passages 52, 53 and connection apertures 64, 65 before the connection, the passages are closed by the valve body 95 (see FIG. 8A). In the communication passages 52, 53 and connection apertures 64, 65 after the connection, both valve bodies 91, 95 push each other, counter the bias force of the springs 93, 97 and move in a direction to open the passages. In this way, the communication passages 52, 53 and the passages of the connection apertures 64, 65 communicate with each other (see FIG. 8B). In the meantime, the connection apertures 64, 65 are each provided with a seal member 98 that seals the communication passages 52, 53. By using the mountable/demountable joint, the work of connecting the communication passages 52, 53 to the main tank 60 becomes easy.

<Modification 3>

Figure 9B:
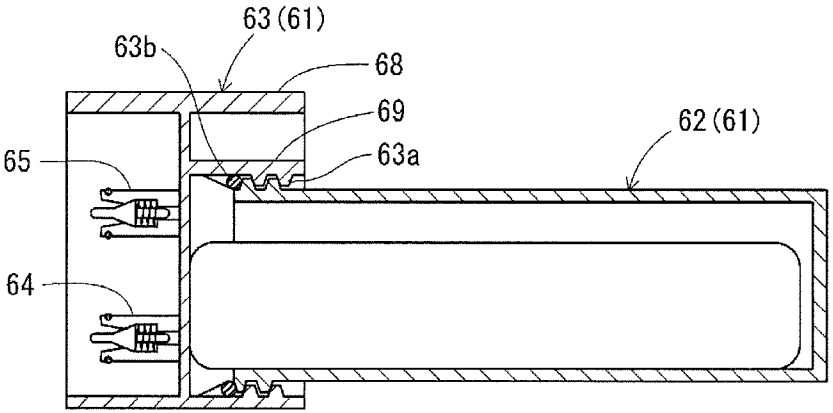
FIG. 9B shows a side view of the main tank according to the modification 3 of the embodiment.
Figure 9A:
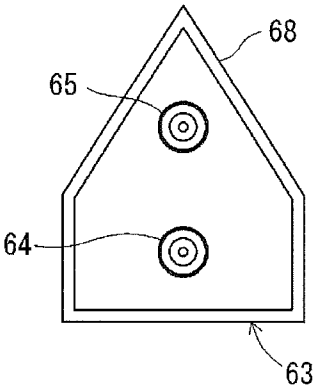
FIG. 9A shows a side view of a main tank according to a modification 3 of an embodiment.

The present modification modifies the structure of the lid member 63 of the main tank 60 of the above embodiment. As shown in FIG. 9A, FIG. 9B, the lid member 63 of the present modification has a lid main body 68 having a pentagonal shape in a planar view. An inner side of the lid main body 68 is provided with a fastening portion 69 on which a tap 63*a* is formed. In FIG. 9A, as to the pentagonal shape of the lid main body 68, an upper half portion has a triangular shape and a lower half portion has a quadrangular shape. And, in the lid main body 68, the quadrangle-shaped portion is provided with a first connection aperture 64, and the triangle-shaped portion is provided with a second connection aperture 65. In the meantime, the ink bag 66 is connected to the second connection aperture 65.

In the present modification, by forming the shape of the lid main body 68 into an asymmetric shape like the above pentagonal shape, it is possible to easily recognize which one of the two connection apertures 64, 65 is formed for the first communication passage 52 or the second communication passage 53. Accordingly, it is possible to prevent mistakenly connecting the communication passages 52, 53 and the connection apertures 64, 65 of the lid member 63 to each other. In the meantime, in the lid main body 68, the positions of the two connection apertures 64, 65 may be reverse. In other words, in the lid main body 68, the quadrangle-shaped portion may be provided with the second connection aperture 65 and the triangle-shaped portion may be provided with the first connection aperture 64.

Figure 10B:
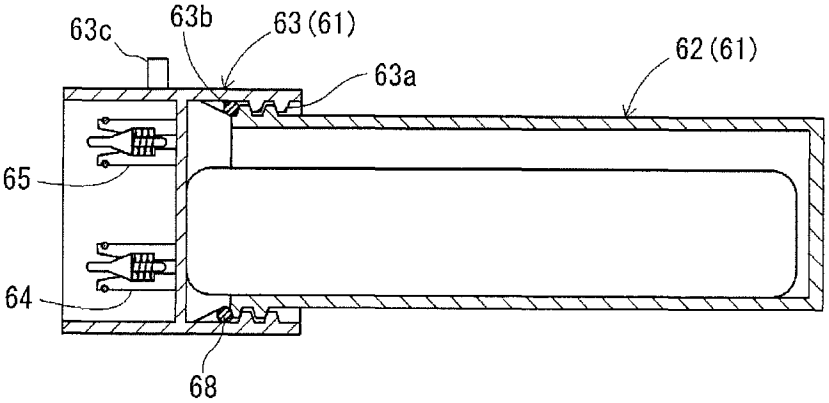
FIG. 10B shows a cross-sectional view of another example of the main tank according to the modification 3 of the embodiment.
Figure 10A:
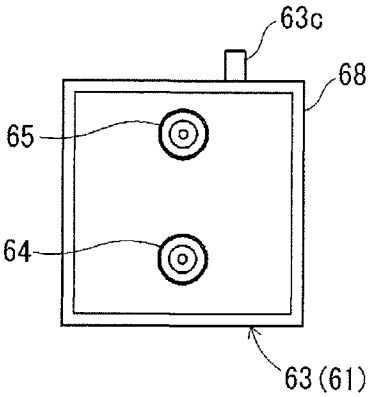
FIG. 10A shows a cross-sectional view of another example of the main tank according to the modification 3 of the embodiment.

Besides, the structure of the lid member 63 is not limited to the above structure, but may be formed as shown in FIG. 10A, FIG. 10B. In other words, the lid member 63 has the lid main body 68 having a quadrangular shape in a planar view, and a side wall near the first connection aperture 64 or the second connection aperture 65 of the lid main body 68 is provided with a protrusion 63*c*. Also by employing such a structure, it is possible to easily recognize which one of the two connection apertures 64, 65 is formed for the first communication passage 52 or the second communication passage 53. Accordingly, it is possible to prevent the wrong connection between the communication passages 52, 53 and the connection apertures 64, 65.

—Other Embodiments—

In the above embodiment, the liquid supply mechanism is described which supplies the ink as the printing liquid. However, the present disclosure is not limited to this, but is also applicable to a liquid supply mechanism that supplies a material, as the printing liquid, used for printing by a 3D printer, for example.

Besides, in the above embodiment, as an example of the printing device 100, the ink jet printer is described. However, the present disclosure is not limited to this, but other printing devices such as a copy machine, a multi-function machine and the like may be used.

Besides, in the above embodiment, the printing device 100 of so-called line type is described. However, it goes without saying that the present disclosure is applicable to a printing device of so-called serial type in which the ink jet head moves and the sheet P passes gradually.

INDUSTRIAL APPLICABILITY

As described above, the present disclosure is useful for a liquid supply mechanism that supplies a printing liquid to a printing portion and for a printing device that includes the liquid supply mechanism.

REFERENCE SIGNS LIST

100 printing device
2 ink jet head (printing portion)
5Y, 5M, 5C, 5K line heads (printing portions)
50 ink supply mechanism (liquid supply mechanism)
51 supply passage
52 first communication passage
53 second communication passage
60 main tank
62 cylindrical member
63 lid member
64 first connection aperture (connection aperture)
65 second connection aperture (connection aperture)
66 ink bag (liquid bag, partition member)
67 gasket (partition member)
70 sub-tank

The invention claimed is:

1. A printing device, comprising:

a liquid supply mechanism comprising:

a main tank that is sealed and stores a printing liquid, a sub-tank which is disposed below the main tank, an inside of the sub-tank contacting outside air, the sub-tank storing the printing liquid supplied from the main tank and supplying the stored printing liquid to a printing portion, the printing portion being disposed at a position higher than a liquid surface of the printing liquid in the sub-tank, and the printing portion being supplied with the printing liquid from the sub-tank of the liquid supply mechanism to apply printing to a print medium, a first communication passage whose one end extends into the printing liquid in the main tank and whose other end extends into the printing liquid in the sub-tank, and a second communication passage one end of which extends into the main tank, an other end of which extends to a position as high as or higher than the other end of the first communication passage in the sub-tank, and a portion of which is disposed at a position higher than an uppermost position of a liquid surface of the printing liquid in the main tank, wherein in the main tank, a cylindrical member and a lid member, which is provided with respective connection apertures for the first communication passage and the second communication passage, are screwed to each other, wherein a sealed space for storing the printing liquid is formed;

a supply passage whose one end extends into the printing liquid in the sub-tank and whose other end communicates with the printing portion, wherein the printing liquid in the sub-tank is supplied through the supply passage by capillarity in the printing portion.

2. The printing device according to claim 1, wherein the connection apertures, the one end of the first communication passage, and the one end of the second communication passage have each a joint that curbs an outflow of the printing liquid and is mountable/demountable.

3. The liquid supply mechanism according to claim 2, wherein the lid member has a lid main body that has an asymmetric shape when seen in an axis direction of the cylindrical member.

4. The printing device according to claim 1, comprising:

a plurality of the printing portions that perform printing by using printing liquids that have colors different from one another, and a plurality of the liquid supply mechanisms that supply a printing liquid corresponding to each of the printing portions, wherein the plurality of the printing portions being fixedly disposed successively in a conveyance direction of the print medium.

5. A printing device, comprising:

a liquid supply mechanism comprising:

a main tank that is sealed and stores a printing liquid, a sub-tank which is disposed below the main tank, an inside of the sub-tank contacting outside air, the sub-tank storing the printing liquid supplied from the main tank and supplying the stored printing liquid to a printing portion, the printing portion being supplied with the printing liquid from the sub-tank of the liquid supply mechanism to apply printing to a print medium, a first communication passage whose one end extends into the printing liquid in the main tank and whose other end extends into the printing liquid in the sub-tank, and a second communication passage one end of which extends into the main tank, other end of which extends to a position as high as or higher than the other end of the first communication passage in the sub-tank, and a portion of which is disposed at a position higher than an uppermost position of a liquid surface of the printing liquid in the main tank, wherein in the main tank, a cylindrical member and a lid member, which is provided with respective connection apertures for the first communication passage and the second communication passage, are screwed to each other, whereby a sealed space for storing the printing liquid is formed, and wherein the main tank is provided with a partition member that partitions an inside of the main tank into a storing portion of the printing liquid and an air portion, and moves in accordance with reduction in the printing liquid of the storing portion;

a supply passage whose one end extends into the printing liquid in the sub-tank and whose other end communicates with the printing portion, wherein the printing liquid in the sub-tank being supplied through the supply passage by capillarity in the printing portion.

6. The liquid supply mechanism according to claim 5, wherein the partition member is a liquid bag that is housed in the main tank, has flexibility, and is filled with the printing liquid.

7. The liquid supply mechanism according to claim 5, wherein the connection apertures, the one end of the first communication passage, and the one end of the second communication passage have each a joint that curbs an outflow of the printing liquid and is mountable/demountable.

8. The liquid supply mechanism according to claim 7, wherein the lid member has a lid main body that has an asymmetric shape when seen in an axis direction of the cylindrical member.

9. The printing device according to claim 7, comprising:

a plurality of the printing portions that perform printing by using printing liquids that have colors different from one another, and a plurality of the liquid supply mechanisms that supply a printing liquid corresponding to each of the printing portions, wherein the plurality of the printing portions being fixedly disposed successively in a conveyance direction of the print medium.

* * * * *